US008453427B2

(12) United States Patent
Gilchrist et al.

(10) Patent No.: US 8,453,427 B2
(45) Date of Patent: Jun. 4, 2013

(54) NANO-PARTICLE FIELD EXTRACTION THRUSTER

(75) Inventors: Brian E. Gilchrist, Ann Arbor, MI (US); Alec D. Gallimore, Ann Arbor, MI (US); Thomas M. Liu, Ann Arbor, MI (US); Louis Musinski, Waltham, MA (US); Joanna Mirecki Millunchick, Ann Arbor, MI (US)

(73) Assignee: The Regents of The University of Michigan, Ann Arbor, MI (US)

( * ) Notice: Subject to any disclaimer, the term of this patent is extended or adjusted under 35 U.S.C. 154(b) by 972 days.

(21) Appl. No.: 12/506,526

(22) Filed: Jul. 21, 2009

(65) Prior Publication Data

US 2010/0018184 A1 Jan. 28, 2010

Related U.S. Application Data

(60) Provisional application No. 61/082,610, filed on Jul. 22, 2008.

(51) Int. Cl.
*H05H 1/00* (2006.01)

(52) U.S. Cl.
USPC ..... 60/202; 60/204

(58) Field of Classification Search
USPC ..... 60/202
See application file for complete search history.

(56) References Cited

U.S. PATENT DOCUMENTS 3,585,441 A * 6/1971 LaRocca ..... 315/111.01
4,838,021 A * 6/1989 Beattie ..... 60/202
5,239,820 A 8/1993 Leifer et al.
5,570,789 A * 11/1996 Dunn ..... 209/12.2
5,947,421 A * 9/1999 Beattie et al. ..... 244/171.1
6,996,972 B2 * 2/2006 Song ..... 60/202
7,115,881 B2 * 10/2006 Rabinowitz et al. ..... 250/423 R
7,584,601 B2 * 9/2009 Metcalfe et al. ..... 60/202
7,872,848 B2 * 1/2011 Song ..... 361/226
2005/0210859 A1 9/2005 Bossmann et al.
2007/0033920 A1 2/2007 Song

FOREIGN PATENT DOCUMENTS

JP 04-076275 A 3/1992

OTHER PUBLICATIONS

International Search Report and Written Opinion in corresponding PCT Application No. PCT/US2009/051340 dated Mar. 4, 2010.

* cited by examiner

*Primary Examiner* — Ehud Gartenberg
*Assistant Examiner* — Arun Goyal
(74) *Attorney, Agent, or Firm* — Harness, Dickey & Pierce, P.L.C.

(57) ABSTRACT

A nano-particle field extraction system comprising a grid having a plurality of electrodes each defining an electrical field, wherein the grid has a plurality of vias extending therethrough. The system further comprises a reservoir having a generally dry mixture disposed therein, a plurality of particles suspended in the generally dry mixture, a biasing member applying a biasing force to the generally dry mixture in the reservoir, and a sieve electrode system in electrical communication with the grid. The sieve electrode system has a plurality of through-holes extending from the reservoir to the grid, such that the sieve electrode system cooperates with the biasing member to extract at least one particle from the generally dry mixture and into the grid whereby the electrical fields charge and accelerate the particle in the vias.

19 Claims, 8 Drawing Sheets

NANO-PARTICLE FIELD EXTRACTION THRUSTER

CROSS-REFERENCE TO RELATED APPLICATIONS

This application claims the benefit of U.S. Provisional Application No. 61/082,061, filed on Jul. 22, 2008. The entire disclosure of the above application is incorporated herein by reference.

GOVERNMENT INTEREST

This invention was made with government support under Grant Nos. FA9550-07-C-0144 and FA9550-09-C-0079 awarded by Air Force Office of Scientific Research. The government has certain rights in the invention.

FIELD

The present disclosure relates to thruster mechanisms and, more particularly, relates to electrostatic thrusters and accelerators using nano- and micro-sized particles with micro- and nano-electromechanical systems (MEMS/NEMS) fabrication technology.

BACKGROUND AND SUMMARY

This section provides background information related to the present disclosure which is not necessarily prior art. This section also provides a general summary of the disclosure, and is not a comprehensive disclosure of its full scope or all of its features.

The Nano-particle Field Extraction Thruster (nanoFET) concept is an approach for nano-particle acceleration to high speeds. According to the present teachings, nano-particles can be delivered without being suspended in a liquid. Particles can be completely dry, lightly lubricated, or treated to minimize particle cohesion. Sieve-like structures and mechanical vibration are used to overcome particle cohesion and adhesion effects to move particles from storage to the nanoFET charging and extraction grid. In addition to aerospace propulsion applications, nanoFET acceleration of nano-particles can be utilized in materials processing, nano-printing, and biomedical applications, to name a few.

Sieve-like structures can be placed between the extraction and acceleration grids in the nanoFET and its particle reservoir with characteristics dimensions close to that of the nano-particles and larger. Multiple sieve grids can be used. The smallest structures can be based on MEMS/NEMS technology. The mechanical vibrations are accomplished via a combination of one or more external vibrating sources and integrated sources that are part of the MEMS/NEMS structures.

Using high speed nano-particles, it is possible to modify material surface properties for improved performance in materials processing. By this method, sputtering, deposition, and implantation are feasible. An important subcategory of this includes enabling improved semiconductor performance through use of nano-particles in fabrication.

Nanometer and micron-scale printing on a wide variety of materials (e.g., paper, plastics, semiconductors, and other targets) are possible for applications such as high security printing, high resolution marking, and direct circuit fabrication including for semiconductor devices. Using the nanoFET architecture of the present teachings, it is possible to consider precise, nanometer placement of particles and control of the energy of deposition.

Furthermore, biomedical applications will benefit from the ability to energetically inject nano-particles in-vivo. This allows the opportunity for treatments through the skin and drug placement at a cellular level. It will be a tool for both treatment and research.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
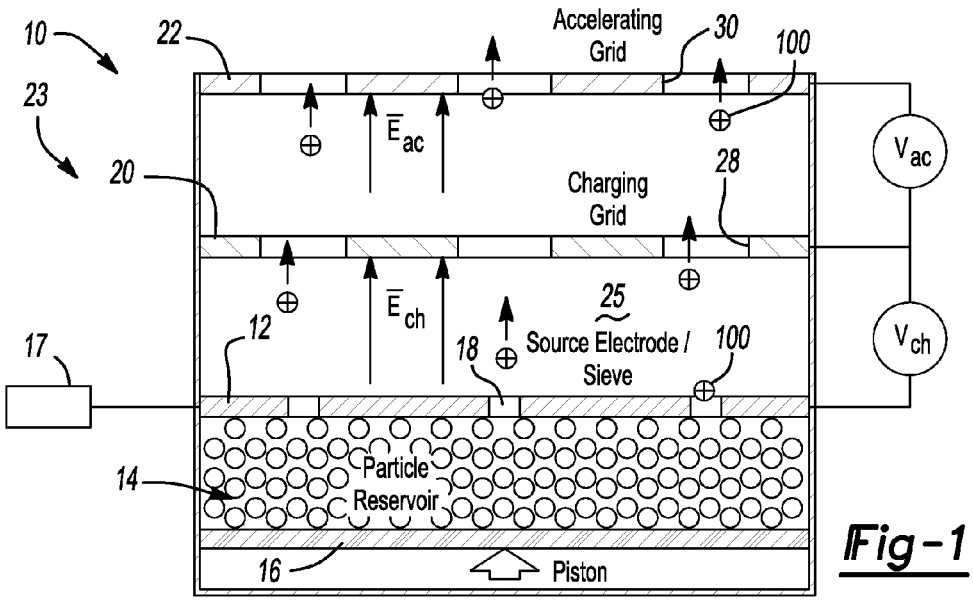
FIG. 1 is a schematic view illustrating a liquidless configuration of a Nano-particle Field Extraction Thruster system according to the principles of the present teachings.

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Nomenclature

The following nomenclature will be used throughout the present teachings:

| |
|---|
| A = Area [$m^2$] |
| D = Electrode gap [m] |
| d = Particle diameter [m] |
| E = Electric field [V/m] |
| $\epsilon$ = Permittivity [F/m] |
| F = Force on particle [N] |
| g = Gravitational acceleration [$m/s^2$] |
| h = Lifshitz-van de Waals constant [J] |
| r = Particle radius [m] |
| $r_c$ = Contact radius [m] |
| $\rho$ = Particle mass density [$kg/m^3$] |
| V = Electric potential [V] |
| z = Van der Waals separation [m] |

Liquidless NanoFET

The use of charged and accelerated micro- or nano-particles was first presented by the inventors of the present application in U.S. Pat. No. 7,516,610, issued on Apr. 14, 2009, the teachings of which are hereby incorporated by reference. A principal focus of the '610 patent was the extraction of nano-particles suspended in insulating and conducting liquids.

With reference to FIG. 1, the present teachings provide a method and apparatus for the transporting, charging, and extracting of micro or nano-particles stored primarily dry or with little or no liquid, to be referred to as the liquidless nanoFET system 10. Liquidless nanoFET system 10 provides a system for the delivery, charging, and acceleration of nano-particles generally using a method of transporting dry particles 100 through one or more ultra-fine conducting sieve electrode system 12 that serves as a source electrode to separate the clumped nano-particle powder into individually isolated particles 100 prior to charging and acceleration. It should be understood that a plurality of sieve electrode systems can be used in series if desired.

In some embodiments, liquidless nanoFET system 10 consists of a particle storage reservoir 14 directly against sieve electrode system 12 with a biasing member 16, such as a spring or control piston, that supplies pressure to help urge particles 100 through sieve electrode system 12. It should be understood, however, that biasing member 16 can be replaced with other urging devices and, in some cases, gravitational forces can be used in place of a dedicated biasing member.

In some embodiments, liquidless nanoFET system 10 can comprise a vibrational source 17. Vibrational source 17 can be a vibrating member or, in some cases, can be other mechanical or acoustical devices capable of imparting a mechanical or other force to disrupt the bond between adjacent particles, surfaces, or other matter.

Sieve electrode system 12 comprises at least one, but preferably a plurality, of through-hole openings or orifices 18 extending from a first side of sieve electrode system 12 to a second side thereof. The first side is adjacent particle storage reservoir 14 and receives particle 100 therefrom. The second side is in communication with a volume 25 discussed below. In some embodiments, the through-hole openings 18 of sieve electrode system 12 are sized slightly larger than the size of particle 100 so that only one particle is capable of passing through each sieve orifice 18 at a time. This assists in breaking the clumped nano-particle powder within particle storage reservoir 14 into individually isolated particles 100. However, it should be appreciated that in some embodiments where extraction of individual particles is not required, openings 18 can be sized such that two or more particles 100 can pass therethrough simultaneously.

Liquidless nanoFET system 10 further comprises a charging grid 20 and an acceleration grid 22, stacked above sieve electrode system 12 and in communication with volume 25, which can collectively be referred to as grid 23. It should be appreciated, however, that in some embodiments acceleration grid 22 can be eliminated and in some embodiments a plurality of acceleration grids 22 can be used. The construction and operation of charging grid 20 and acceleration grid 22 are similar to that described in commonly-assigned U.S. Pat. No. 7,516,610. Briefly, an electrical potential (i.e., $V_{ac}$, $V_{ch}$, etc.) can be applied between adjacent electrodes to define electric field therebetween (i.e., $E_{ac}$, $E_{ch}$, etc.) acting upon the associated particle. In other words, electric potentials are applied across the conducting sieve electrode system 12 and the charging grid 20 and acceleration grid 22 to generate the charging and accelerating electric fields used to charge and accelerate the individual particles 100 that pass through sieve electrode system 12. Once a particle 100 has charged and lifted off from sieve electrode system 12, the applied electric field accelerates particle 100 to high speeds through vias 28, 30 formed in charging grid 20 and accelerating grid 22, respectively.

As briefly described above, in some embodiments, a variety of vibrational sources 17 can be used to overcome particle cohesion and adhesion effects to move particles from storage to the nanoFET charging grid 20 and accelerating grid 22. These vibrational sources can, in some embodiments, move the entire nanoFET structure, sieve electrode system 12 structure only (as shown), and/or use surface acoustic devices that launch surface waves on the charging side of sieve electrode system 12 (opposite side from particle reservoir 14). One specific example is an axial ring piezoelectric device to vibrate the interface between particle 100 and sieve electrode system 12. When a vibration and backpressure are applied, particles 100 that come in contact with sieve electrode system 12 pass through orifice 18 of sieve electrode system 12 and the vibration motion force acts in combination with the applied charging electric field to extract individual particles and launch them through the acceleration grids 22. As the frequency of an oscillating piezoelectric device is increased, the resulting inertial force is amplified. Therefore, as the vibration frequency and/or amplitude is varied, the mass flow rate of particles 100 can be effected.

Figure 2:
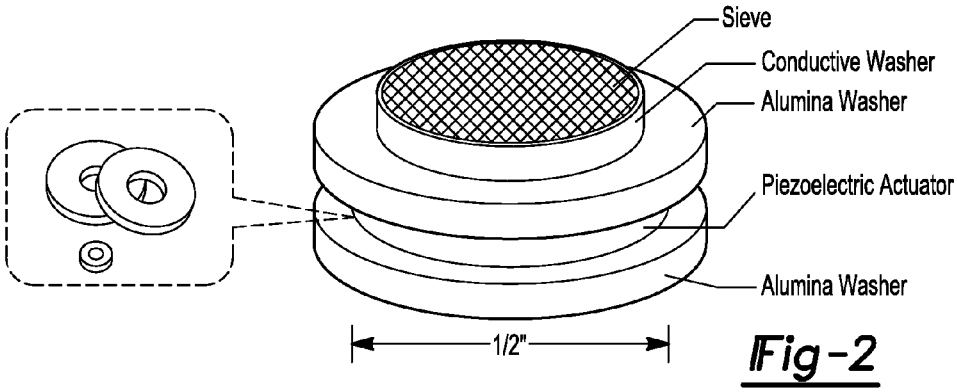
FIG. 2 is a schematic view illustrating an exemplary piezoelectric assembly according to some embodiments of the present teachings, wherein a piezoelectric actuator that is electrically insulated from the charged particles vibrates a mounted particle sieve to facilitate particle passage through the sieve.

As an example, the inertial force that facilitates particle passage through sieve electrode system 12 and particle liftoff after charging may be provided by a piezoelectric stack, as illustrated in FIG. 2. In this configuration (which can be adjusted to include piezoelectrics providing lateral and bending modes of motion as well as piezoelectrics imbedded in the NanoFET NEMS/MEMS structure), a ring piezo provides axial vibrations to the particle sieve (electrically biased via a conductive washer in this case, though other connectors are possible) mounted above it. The piezoelectric is electrically insulated from the sieve and particle reservoir by dielectric material (e.g., alumina in this case). By adjusting the piezoelectric's driving waveform, amplitude, and frequency, NanoFET's flow rate can be tuned.

The nanosieve that typically require micron to nanometer scale sized 3-dimensional structures are fabricated using micro and nano electromechanical system (MEMS/NEMS) manufacturing technologies. Specific sieve substrate materials depend on specific applications, but include semiconductor, conductors, as well as silicon nitride, ceramics, and other insulators and conductors. The second side of the sieve electrode system 12 must be conducting as defined by the bulk material of sieve electrode system 12 or by metal coatings such as gold or platinum or others. The nanosieve through-holes can be defined using similar techniques as for charging grid 20 and acceleration grids 22. Examples include semiconductor fabrication techniques to define structures using etching based on photons (photolithography) or electron beams (E-beam lithography), or direct surface milling using focused ion beams (FIB) to define the structures. Sieve electrode system 12 as shown in FIG. 1 is of single thickness, but a hierarchical architecture (greater thickness away from the through-hole regions) can be used combining small openings with the macro-level mechanical properties of liquidless nanoFET system 10. The width of the nanosieve through-hole regions in sieve electrode system 12 and the thickness of the supporting regions are optimized to maximize mechanical properties while meeting the specifications of hole size and coverage depending on particular applications. There may be as few as one or many distinct through-hole regions forming a particular realization of sieve electrode system 12.

Adhesion and Cohesion Forces

Previous studies working with nanometer and micron sized particles explain that particles on this size scale have a strong tendency to adhere to each other (cohesion) and to other objects that they contact (adhesion). Therefore, an understanding of the adhesion and cohesion forces and how to overcome them is extremely important to the development of the liquidless nanoFET system 10 to assure that most particles 100 do not clump together through cohesion or stick to sieve electrode system 12 through adhesion. The present disclosure presents a theoretical analysis of the adhesion and cohesion forces. In addition, the electric force arising from the charging electric field acting on the charged particles is investigated, both theoretically and experimentally, as a method to overcome the adhesion force and achieve particle removal from the source electrode 12. Finally a proof-of-concept experiment with the goal of demonstrating the feasibility of overcoming the cohesion force with liquidless nanoFET system 10 is presented.

There are four primary forces generally credited for the adhesion and cohesion of small particles. The relative magnitude of these forces is dependent on the size of particles 100, the materials involved, and the environmental conditions. The most dominant of these forces when considering dry, conducting particles smaller than several hundred microns is the van der Waals force.

The van der Waals force between atoms arises when an apolar atom momentarily has a dipole moment due to the movement of its electrons with respect to its nucleus. This momentary dipole creates an electric field, which induces dipole moments in neighboring atoms. The resulting dipoles attract each other as the positive end of one atom aligns with the negative end of another.

The van der Waals force between macroscopic bodies is calculated by taking the summation of the van der Waals forces between the atoms of the different bodies. The van der Waals force density between two infinite parallel planar surfaces is calculated to be dependent on the Lifshitz-van der Waals constant, h, and the separation between the surfaces, z.

$$\frac{F_{vdw}}{A} = \frac{h}{8\pi^2 z^3} \tag{1}$$

The Lifshitz-van der Waals constant has units of energy and is a function of the material combination involved. The values for select materials are published, but are disputed by many authors. It is accepted that typical values of the Lifshitz-van der Waals constant range from 0.6 to 9.0 eV. According to Curran, a minimum separation distance of 4 Angstroms is acceptable when evaluating the van der Waals force.

Using the van der Waals force density between two parallel planar surfaces given in Equation (1), the adhesion force between a spherical particle and an infinite planar surface (Equation (2)) and the cohesion force between two spherical particles (Equation (3)) are approximately calculated.

$$F_{vdw-ad} \approx \frac{hr}{8\pi z^2} \tag{2}$$

$$F_{vdw-co} \approx \frac{hr}{16\pi z^2} \tag{3}$$

The simple expressions for the adhesion and cohesion van der Waals forces scale directly with particles' radii and inversely with the square of the minimum separation.

Figure 3:
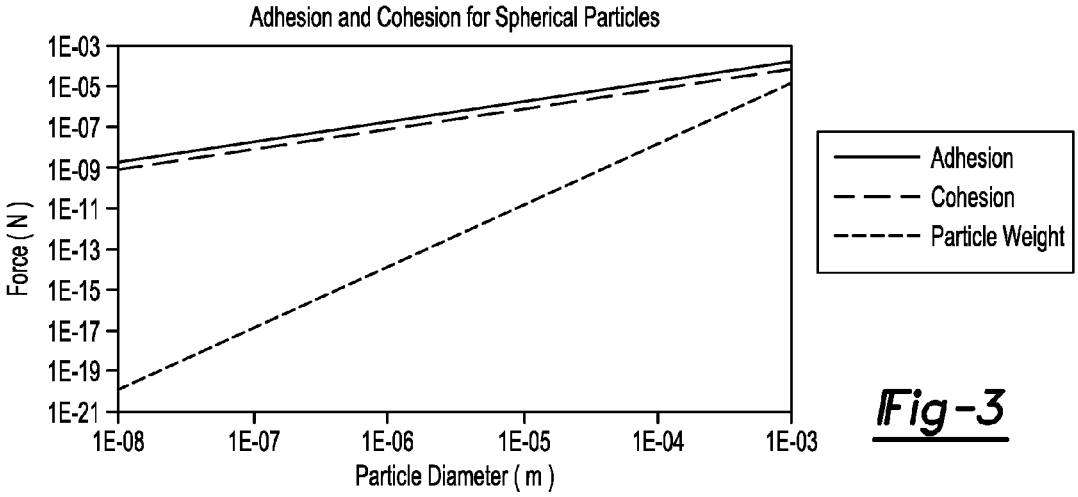
FIG. 3 is a graph illustrating adhesion and cohesion forces (N) using a Lifshitz-van der Waals constant of 9 eV and the weight of an aluminum particle relative to particle diameter (m)

A comparison of the van der Waals forces reveals that the adhesion and cohesion forces scale the same with particle 100 size, but the adhesion force is approximately twice the cohesion force when using particles of the same size. FIG. 3 is a plot of the adhesion and cohesion forces as a function of particle diameter when using a Lifshitz-van der Waals constant of 9 eV. For comparison purposes, the weight of particle 100 is included in the plot when particle 100 is made from aluminum.

The plot in FIG. 3 shows that as particle 100 size decreases, the adhesion and cohesion forces decrease. This is somewhat misleading because, by comparison to the gravitational force, both the adhesion and cohesion forces become more significant for smaller particles.

Overcoming the Adhesion Force Using High Strength Electric Fields

The removal of micro- and nano-particles from surfaces is important to many applications, particularly in the MEMS and pharmaceutical industries. A few techniques currently used for particle removal are ultrasonic vibration, mechanical vibration, and laser irradiation. These techniques work by accelerating particles relative to the surface. This section investigates an alternative method of particle removal using high strength electric fields, which lends itself nicely to the design of micro- and nano-particle thrusters, which use high strength electric fields to charge particles 100 when they are in contact with the source electrode. This section presents the electric force on a spherical conducting particle when in contact with an infinite planar electrode and applies this force to determine the required electric field to overcome the van der Waals adhesion force.

Figure 4:
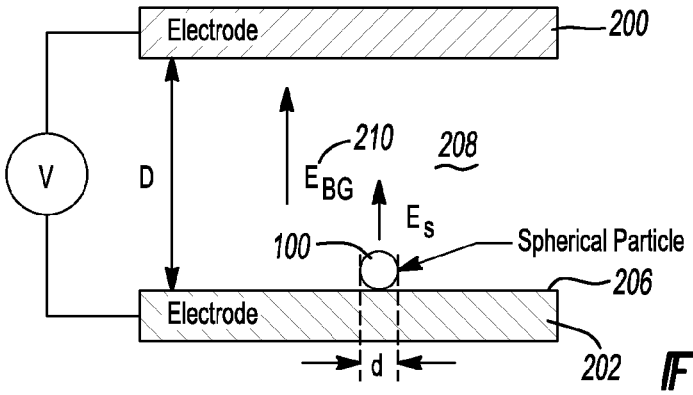
FIG. 4 is a schematic view illustrating the removal of a conducting spherical particle from a planar electrode using a high strength electric field.

The model for spherical particle removal from a planar electrode is shown in FIG. 4 and consists of two infinite parallel electrodes 200, 202 with a conducting spherical particle 100 in contact with the upper surface 206 of the bottom electrode 202. An electric potential bias, V, is applied across the electrodes 200, 202 to generate an electric field 210 within the gap 208 formed between electrodes 200, 202.

The complete derivation of the electric force on the spherical particle 100 when in contact with the source electrode is beyond the scope of these teachings. Felici calculated it when assuming particle is much smaller than the electrode gap (d<<D).

$$F_{el} \approx 5.5\pi r^2 \in E_{BG}^2 \tag{4}$$

Using the model for the electric force on a conducting particle in contact with the source electrode from Equation (4) and the van der Waals adhesion force from Equation (2), the threshold background electric field for particle removal can be calculated when the van der Waals force is dominant. It is important to include the gravitational force on the particle in this calculation to show where the adhesion force becomes more important than gravity.

$$F_g = \frac{4}{3}\pi r^3 \rho g \tag{5}$$

By combining Equations (2), (4), and (5), the threshold background electric field for overcoming the adhesion force is estimated when particle 100 is much smaller than the electrode gap.

$$E_{thresh} \approx \sqrt{\frac{1}{r}\frac{h}{z^2\varepsilon}(0.0023) + r\frac{\rho g}{\varepsilon}(0.24)} \tag{6}$$

It is important to note that the threshold electric field can be broken down into two terms: the adhesion dominant term and the gravitational dominant term. The adhesion dominant term scales inversely with the square root of the size of particle 100 while the gravitational term scales directly with the square root of the size of particle 100.

Figure 5:
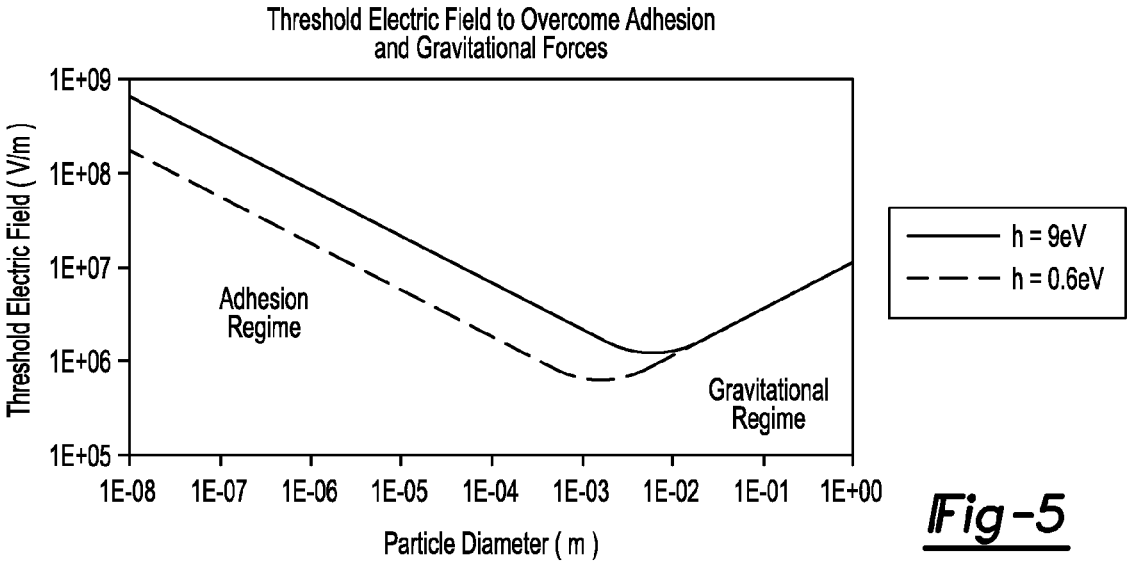
FIG. 5 is a graph illustrating the threshold electric field to overcome the adhesion and gravitational forces holding a spherical particle in contact with a source electrode relative to particle diameter (m) for two Lifshitz-van der Waals constant values, 0.6 and 9 eV.

FIG. 5 is a plot of the predicted threshold electric field for overcoming the van der Waals adhesion force and the gravitational force for the two cases when the Lifshitz-van der Waals constant is 9 eV and 0.6 eV. Particle density is assumed to be 1,000 kg/m$^3$ and the surrounding medium is vacuum.

The plot of the threshold electric field clearly illustrates the two regimes. Particles much larger than the centimeter range lie within the gravitational regime and particles much smaller than millimeter range lie within the adhesion regime. Both forces affect particles between these two ranges significantly. According to the plot, it may be possible to remove spherical particles with diameters as small as tens of nanometers when keeping the background electric field less than approximately 100 MV/m, which is below the level required for electron emission.

A. Experimental Setup

Figure 6:
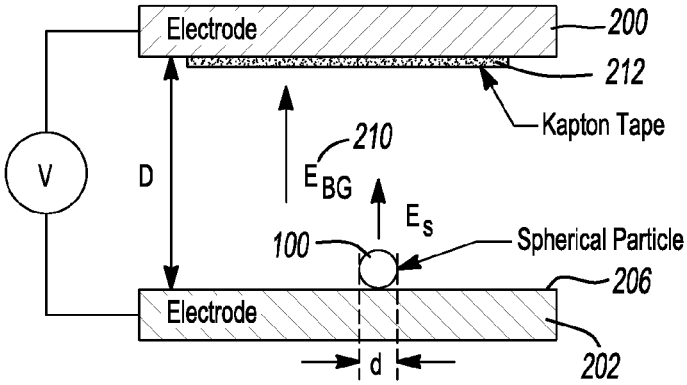
FIG. 6 is a schematic view illustrating the removal of a conducting spherical particle from a planar electrode using a high strength electric field and a Kapton® tape strip mounted to an electrode for validation purposes.

To experimentally investigate the van der Waals adhesion force and to overcome this force by way of an electric force, the system depicted in FIG. 6 was constructed, which is very similar to the model in FIG. 4 with the addition of the thin strip of Kapton® tape 212 over the surface of the upper electrode 200. It is important to note that the Kapton® tape does modify the background electric field slightly, which is taken into account in the results section, but is only present to help capture particles that are lifted off of surface 206.

The goals of the experiment are to measure the threshold electric field required for removing conducting spherical particles from the electrode surface for various particles in the adhesion dominant regime, investigate the effects of particle size on the adhesion force, and investigate the effects of particle 100 and electrode materials on the adhesion force.

The experiment is performed by depositing approximately 100 conducting spherical micro-particles (204) on the surface of the bottom electrode. To prevent these particles from clumping together through cohesion, particles 100 are passed through a micro-sieve to separate the clumps into individual particles prior to placement onto the electrode surface. In some embodiments, it is desirable to have particles 100 separated by a distance of at least ten times their diameter to ensure that neighboring particles do not affect the electric field profile at their surfaces. Once particles 100 are deposited, the upper electrode 200 is secured in place to provide the correct uniform electrode gap, which can be defined through the use of a spacer, such as 1.0 mm or 4.0 mm thick. Next, the voltage across the electrodes 200, 202 is increased incrementally to generate the strong electric field within the gap 208. At each voltage increment, a photograph of the particles remaining in contact with the source electrode 202 is taken to provide visual evidence of the number of particles removed. The process is repeated until all of the particles have been removed. Finally, the number of particles removed from the electrode surface 206 at each voltage increment is counted, providing an experimental measurement of the threshold electric field required for particle removal.

The particles removed from the source electrode 202 during testing are accelerated across the electrode gap 208 towards the upper electrode and onto the Kapton® tape 212, where they remain trapped. The Kapton® tape 212 serves to collect the removed particles so that they do not oscillate between the electrodes 200, 202 and disrupt the particles still adhered to the bottom electrode 202. The Kapton® tape 212 used for this experiment had a thickness of approximately 25 μm and typically has a relative dielectric constant of approximately 2.7.

The experiment was performed with four different spherical particle sizes, ranging in diameter from 53 microns to 305 microns, which are all in the adhesion dominant regime. Table 1 lists the mean diameters, tolerances, materials, densities, and manufacturers of the particles.

TABLE 1

Properties of the four particles used in particle 100 adhesion experiment.

| Mean Diameter (μm) | Tolerance (±μm) | Material Composition | Density (kg/m$^3$) | Manufacturer |
|---|---|---|---|---|
| 305 | 10 | 95% Sn/ 5% Sb | 7,250 | Indium Corp |
| 196 | 16 | Soda-lime glass coated w/ Ag | 2,500 | Mo-Sci Corp |
| 102 | 10 | 95% Sn/ 5% Sb | 7,250 | Indium Corp |
| 53 | 4 | Soda-lime glass coated w/ Ag | 2,500 | Mo-Sci Corp |

Figure 7:
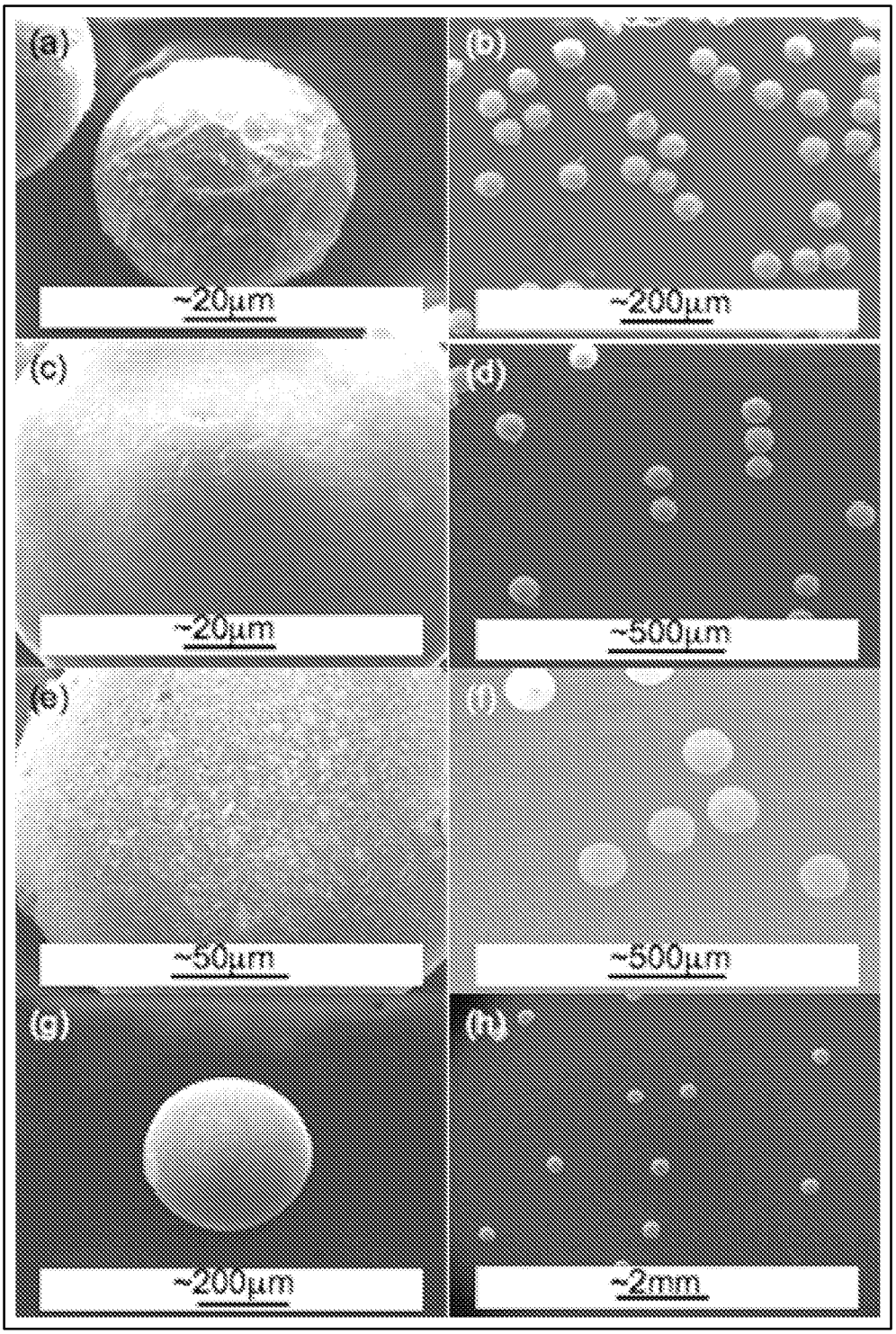
FIGS. 7A-7B is a series of scanning electron microscope (SEM) photographs illustrating approximately 53-micron particles made of glass with silver coating that were collected following liftoff.
FIGS. 7C-7D is a series of scanning electron microscope (SEM) photographs illustrating approximately 102-micron particles made principally of tin that were collected following liftoff.
FIGS. 7E-7F is a series of scanning electron microscope (SEM) photographs illustrating approximately 196-micron particles made of glass with silver coating that were collected following liftoff.
FIGS. 7G-7H is a series of scanning electron microscope (SEM) photographs illustrating approximately 305-micron particles made principally of tin that were collected following liftoff.

FIG. 7 is a set of photographs of the four particle types and includes a close-up shot and a distance shot of each particle size. These photographs were taken using a scanning electron microscope (SEM).

The photos in FIG. 7 confirm the tolerances that were reported by the manufacturers and that particles 100 are very close to spherical. But, it should be noted that the surfaces of particles 100 are not perfectly smooth, which is assumed in the model. The silver coated glass particles appear to have much rougher surfaces than the 95Sn/5Sb particles. The effects of the rough particle surfaces are addressed in more detail in a later section.

The experiment was performed with two different electrode materials-gold and platinum. These materials were chosen because they do not oxidize when exposed to the atmosphere unlike most other metals. When manufacturing the electrodes, the two biggest concerns were controlling the surface flatness and the surface roughness. Controlling surface flatness is important for reducing the error in the applied electric field since a warped surface can lead to varying electric field strengths at the electrode surface. The surface roughness is important because the model for the van der Waals adhesion force assumes that the surface of the electrode is perfectly smooth.

Figure 8:
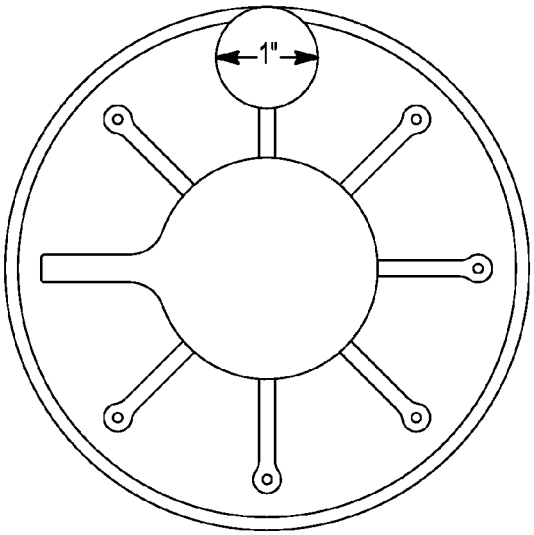
FIG. 8 is a photograph illustrating a gold electrode deposited on a glass wafer for adhesion experiments.

To minimize the surface roughness and control the flatness, the electrodes were fabricated using plasma vapor deposition of the metals onto glass wafers. All depositions were performed using the EnerJet Evaporator at the Lurie Nanofabrication Facility (LNF) located at the University of Michigan. The gold electrodes were fabricated by depositing 300 nm of gold on top of a 30 nm adhesion layer of chromium, and the platinum electrodes were fabricated by depositing 100 nm of platinum on top of a 10 nm adhesion layer of titanium. FIG. 8 is a picture of one of the gold electrodes.

The electrodes are circular with 50 mm diameters and were deposited onto 100 mm glass wafers. A thin tail of metal stretches from the electrode and wraps around the wafer to provide an electrical connection on the reverse side.

An atomic force microscope (AFM) was used to measure the surface roughness of both the gold and platinum electrodes, and both were found to have a surface roughness on the order of 20 nm. The effects of the electrode surface roughness are presented in an upcoming section.

The experiment was performed in the Ultra High Vacuum (UHV) chamber at the Space Electrodynamics and Tether Systems (SETS) laboratory at the University of Michigan, which is pumped by a mechanical roughing pump and a turbo pump and has an ultimate pressure on the order of $10^{-9}$ Torr. Each experiment was performed at a pressure less 40 nTorr to prevent arcing within the electrode gap.

B. Experimental Results

Before presenting the experimental results, it is important to recall that the Lifshitz-van der Waals constant from Equation (2) is not well known for most material combinations. Further, in the cases of reported values, many authors are not in agreement. Therefore, the present disclosure does not assume any values for the Lifshitz-van der Waals constant when analyzing the results. Instead, values for the Lifshitz-van der Waals constant that best fit the experimental results are evaluated and used for comparison between the test cases. The threshold electric field for particle removal is defined as the field strength at which 50% of the particles in contact with the source electrode are removed.

Figure 9:
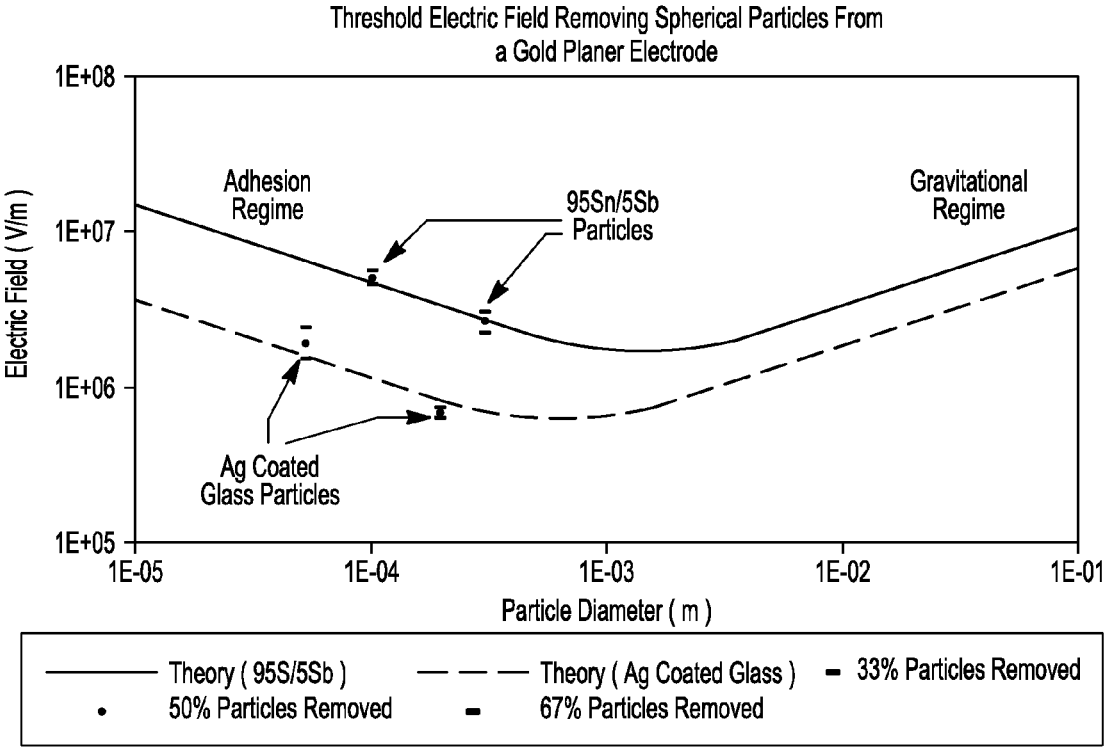
FIG. 9 is a graph illustrating the measured threshold electric fields for removal of spherical particles from a gold planar electrode when in the adhesion dominant regime relative to particle diameter (m)
Figure 10:
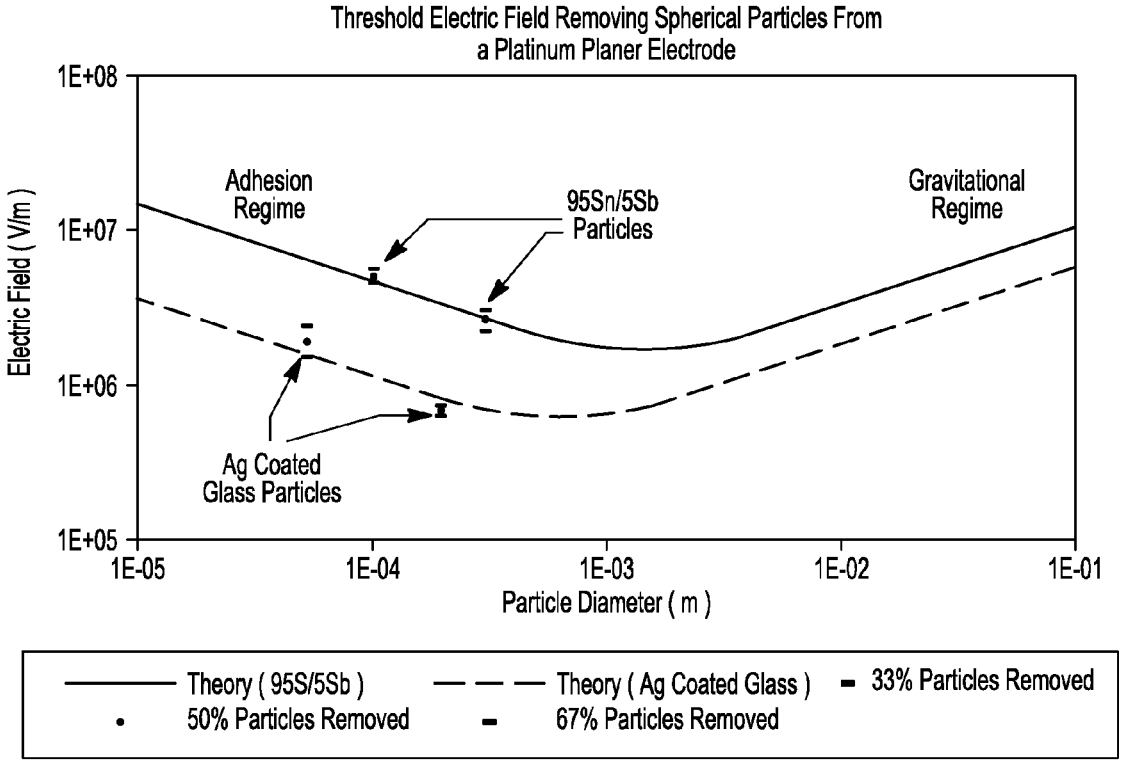
FIG. 10 is a graph illustrating the measured threshold electric fields for removal of spherical particles from a platinum planar electrode when in the adhesion dominant regime relative to particle diameter (m)

FIGS. 9 and 10 are plots showing the measured electric fields required for particle removal for all eight cases tested. Each plot shows the results for all four particle sizes tested against one of the two electrode materials. The solid black dots represent the electric field strength at which 50% of particles 100 tested were removed. The upper and lower dashes represent the electric field strengths at which 33% and 67% of particles 100 were removed, respectively. Each test case measured the threshold electric field of several hundred particles over several experimental runs, with the exception of the 305 μm particles, which used less than ten particles per experimental run due to the tendency of particles 100 to roll off of the electrode during setup. The error in the electrode gap is the largest source of error in the electric fields, which is estimated to be approximately 5%.

The experimental data is plotted against the theoretical threshold electric fields when using the Lifshitz-van der Waals constants evaluated to provide the best fit. Table 2 lists the evaluated Lifshitz-van der Waals constants for the four material combinations used in FIGS. 9 and 10 and are all on the order of the expected range of 0.6 to 9 eV. As predicted by the model, the threshold electric fields required for particle removal increase as particles 100 size decreases for each material combination. But, note the large variation in the threshold electric fields between the two particle materials. This variation may be a result of a difference between the actual Lifshitz-van der Waals constants, a difference between the materials' surface roughness, and/or particle deformation, which are discussed in the upcoming sections. Also, note that changing the electrode material from gold to platinum has very little effect on particle adhesion.

TABLE 2

Lifshitz-van der Waals constants evaluated to match experimental data for all material combinations tested.

| Material Combination | Lifshitz Constant (eV) |
|---|---|
| 95Sn/5Sb—Au | 4 |
| 95Sn/5Sb—Pt | 4 |
| Ag coated glass - Au | 0.2 |
| Ag coated glass - Pt | 0.2 |

Figure 11:
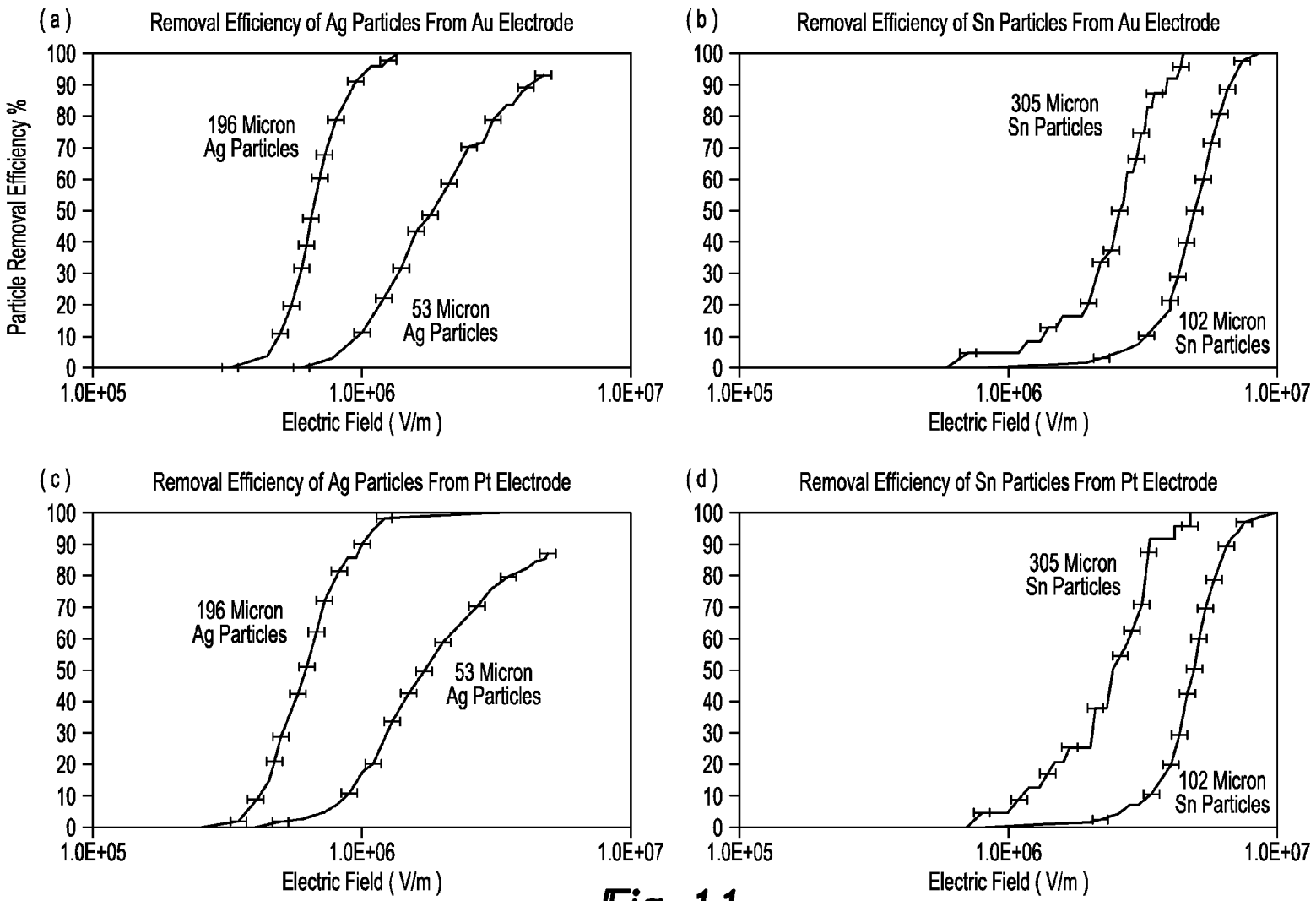
FIGS. 11A-11D are a series of graphs illustrating particle removal efficiency as a function of applied electric field for eight test cases.

The spread of the threshold electric field required for particle removal is larger than expected. FIG. 11 shows the percentage of particles removed as a function of the applied electric field for all eight test cases. To complement FIG. 11, Table 3 lists the median threshold electric field strength for particle removal along with the electric field strengths required to remove 15%, 33%, 67%, and 85% of the particles.

TABLE 3

Threshold electric fields required to remove 15%, 33%, 50%, 67%, and 85% of particles 100.

| | Required Electric Field to Remove Stated Percentage of Particles | | | | |
|---|---|---|---|---|---|
| Particle Size and Materials | 15% (MV/m) | 33% (MV/m) | 50% (MV/m) | 67% (MV/m) | 85% (MV/m) |
| 305 μm Sn on Au | 1.6 | 2.2 | 2.6 | 3.0 | 3.5 |
| 305 μm Sn on Pt | 1.4 | 2.1 | 2.4 | 3.1 | 3.3 |
| 196 μm Ag on Au | 0.53 | 0.63 | 0.68 | 0.73 | 0.85 |
| 196 μm Ag on Pt | 0.48 | 0.53 | 0.63 | 0.70 | 0.88 |
| 102 μm Sn on Au | 3.7 | 4.5 | 5.0 | 5.6 | 6.3 |
| 102 μm Sn on Pt | 3.7 | 4.6 | 4.9 | 5.3 | 6.1 |
| 53 μm Ag on Au | 1.1 | 1.5 | 1.9 | 2.4 | 3.6 |
| 53 μm Ag on Pt | 1.0 | 1.4 | 1.8 | 2.5 | 4.5 |

Potential reasons for the spread in the electric field required for particle removal are presented herein, which include the spread in particle size, particle and electrode surface roughness, and the surface deformation.

C. Variables of the Experiment

While the measured threshold electric fields trend as predicted by the model for each material combination, the evaluated Lifshitz-van der Waals constants for the two particle materials are quite different. The evaluated Lifshitz-van der Waals constants may be reasonable measurements of the actual values, or the difference may also be a result of uncontrolled variables in the experiment. In addition, the spread of the electric fields required for the removal of all the particles is quite large, which may also result from uncontrolled variables in the experiment. This section examines three variables in the experiment.

The first experimental variable to consider is the spread in particle size, which may contribute to the spread in the electric fields required for particle removal. Using the tolerances on particle diameters given in Table 1 and the predicted threshold electric field from Equation (6), the expected electric field spread can be calculated. Table 4 lists the approximate expected electric field spread resulting from particle size spread along with the measured spread to remove 15%-85% and 33%-67% of the particles.

TABLE 4

The estimated spread in the threshold electric field due to the spread in particle size and the measured threshold electric field spread.

| Particle Diameter (μm) | Electrode Material | Theoretical Spread (MV/m) | 33%-67% Measured Spread (MV/m) | 15%-85% Measured Spread (MV/m) |
|---|---|---|---|---|
| 305 | Au | 0.09 | 0.80 | 1.9 |
| 305 | Pt | | 1.0 | 1.9 |
| 196 | Au | 0.07 | 0.10 | 0.33 |
| 196 | Pt | | 0.18 | 0.40 |
| 102 | Au | 0.48 | 1.1 | 2.6 |
| 102 | Pt | | 0.70 | 2.4 |
| 53 | Au | 0.13 | 0.90 | 2.5 |
| 53 | Pt | | 1.1 | 3.5 |

The calculations in Table 4 suggest that the spread in particle size can lead to a spread in the electric field, but not enough to account for the entire spread in the experimental data.

The second experimental variable is possible deformation of particle 100 and/or the source electrode by compression. The model presented in Equation (2) assumes that particle 100 is a perfect sphere and that the electrode is a perfect plane, but, due to defects in particle 100 and/or the electrode, this is most likely not the case. The compression of either particle 100 or the electrode leads to a contact area between the two greater than just the point contact that is assumed. An increase in the contact area leads to an increase in the adhesion force.

Approximating the change in the adhesion force due to the deformation of particle 100 and/or the electrode is not straightforward because the exact geometry after deformation has occurred is unknown and can be quite complex. To approximate the change in the adhesion force resulting from deformation, all of the deformation is assumed to be at the bottom of particle 100. Using Equation (1), the adhesion force with a compressed particle is calculated to be a function of the contact area radius, $r_c$.

$$F_{vdw,def} \approx \frac{hr}{8\pi z^2}\left(r + \frac{r_c^2}{z}\right) \tag{7}$$

Assuming that the electric force on particle 100 does not change significantly if particle 100 experiences a small deformation, which is appropriate as long as the deformation occurs at the bottom of particle 100, the new threshold electric field is calculated by modifying Equation (6) and assuming that particle 100 is in the adhesion dominant regime.

$$E_{thresh,def} \approx \sqrt{\left(\frac{1}{r} + \frac{r_c^2}{r^2 z}\right)\frac{h}{z^2\varepsilon}(0.0023)} \tag{8}$$

Figure 12:
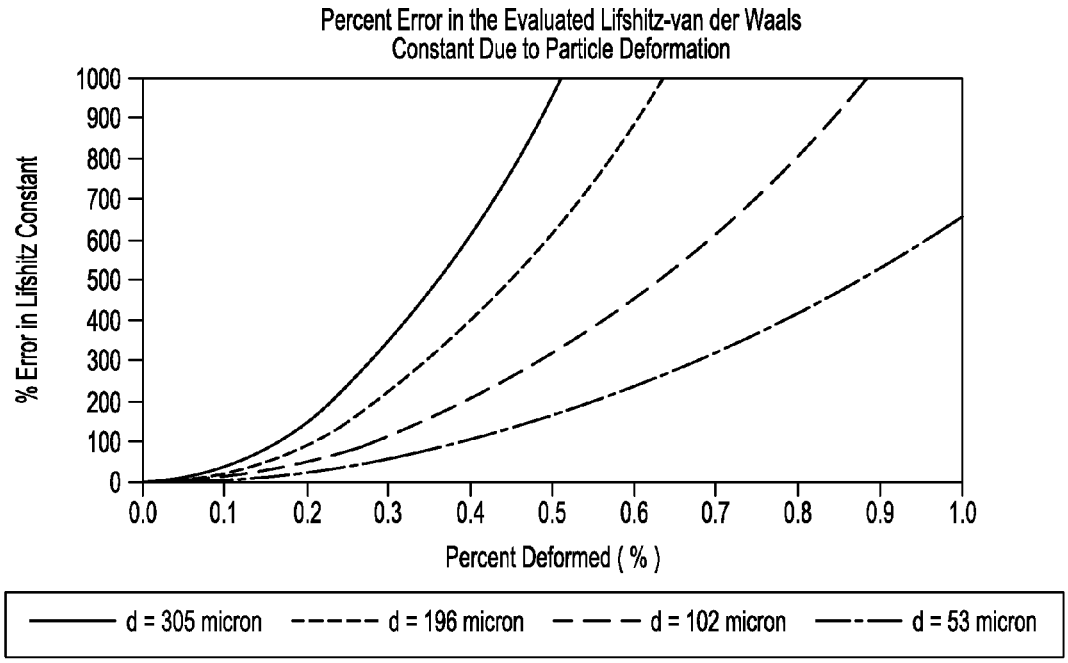
FIG. 12 is a graph illustrating the estimated percent error of the evaluated Lifshitz-van der Waals constants due to deformation of the particle.

The deformation of particle 100 may lead to an error in the evaluated values of the Lifshitz-van der Waals constant from the experimental results. FIG. 12 is a plot of the percent error in the evaluated Lifshitz-van der Waals constants as a function of percent deformation of particle 100 for all four particles tested. The deformation of particle 100 is defined as the ratio of the contact area radius to particle radius, $r_c$:r.

FIG. 12 shows that just a slight deformation of particle 100 can lead to a very large error in the evaluated Lifshitz-van der Waals constant, which could be a large error in the evaluated values listed in Table 2.

Figure 13:
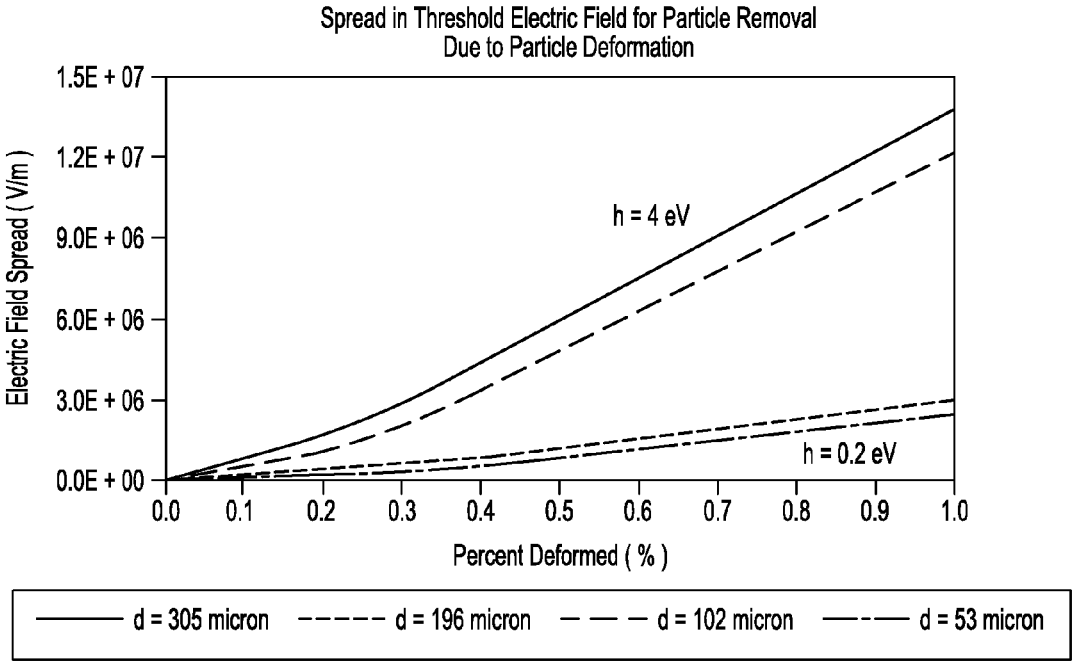
FIG. 13 is a graph illustrating the estimated spread in the threshold electric field due to deformation of the particle.

In addition to increasing the error in the evaluated values for the Lifshitz-van der Waals constant, particle deformation may also be a source of the spread in the electric field required to remove all particles 100. FIG. 13 plots the approximate expected threshold electric field spread resulting from particle deformation for all 4 particle sizes tested. The figure assumes Lifshitz-van der Waals constants of 4 and 0.2 eV for the 95Sn/5Sb and Ag particles, respectively.

Comparing the theoretical spread in the electric field with the measured spread from Table 3, it is very possible that a small deformation could make significant contributions.

The final experimental variable that may potentially influence the electric field spread that is discussed in the present teachings is the surface roughness of both particle 100 and the electrode surface. The surface roughness of the materials in contact can lead to an increase or decrease in the adhesion van der Waals force depending on their relative roughness and alignment. Due to the complexity and large number of variations of surface roughness and alignments, it is not possible to provide a general relationship between the adhesion force and the materials surface roughness. Only in the case when the exact geometry of the two surfaces is known, can Equation (1) be integrated to find the adhesion force.

Figure 14:
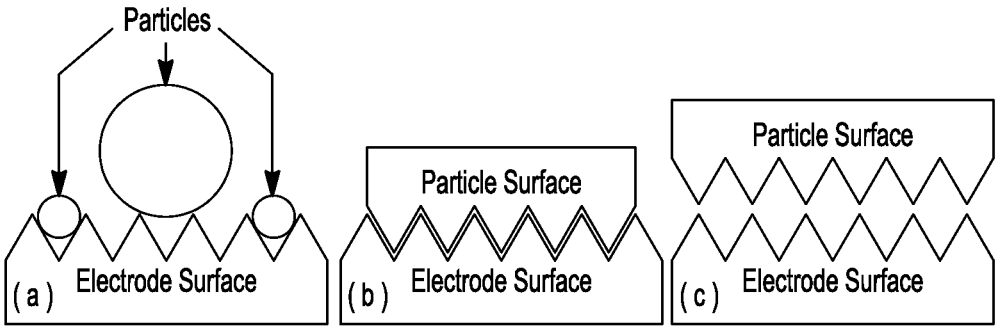
FIGS. 14A-14C are a series of electrode and particle surface orientations illustrating how adhesion forces can vary based on particle and surface geometry.

FIG. 14 illustrates four possible surface orientations between the electrode surface and particle 100. Note that the examples discussed here are not all inclusive and there exist many other possible surface orientations that may lead to a change in the adhesion force.

Sketch (a) from FIG. 14 illustrates two possible situations. First, it is possible that particles 100 are much smaller than the surface roughness of the source electrode. In this case, particles 100 may fit between the peaks and valleys of the electrode, which increases the contact area and increases the adhesion force. Second, it is possible that particles 100 are much larger than the surface roughness and sit on the peaks of the electrode, which decreases the contact area and decreases the adhesion force. Picture (b) illustrates a case when the surface roughness of particle 100 and the electrode are approximately the same and are aligned so that the peaks of particle 100 fit into the valleys of the electrode. Again, this increases the contact area and the adhesion force. Picture (c) illustrates a case when the surface roughness of particle 100 and the electrode are approximately the same and are unaligned so that the peaks of particle 100 and electrode are touching. This decreases the contact area and the adhesion force.

As stated earlier, there exist many other possible orientations between particle 100 and electrode surfaces, and their effects on the adhesion force can be determined by understanding how the contact area changes. Since the surface roughness affects the adhesion force by changing the contact area, it is reasonable to expect that the error in the evaluated values for the Lifshitz-van der Waals constants and the resulting spread of the electric field required for particle removal are on the same order of magnitude as the case of particle deformation.

FIG. 7 is a set of SEM photographs of particles 100 used for the present teachings, and shows that particles 100 all have surface defects on the order of what appears to be microns, but note that the defects on the silver coated glass spheres are much larger than on the 95Sn/5Sb particles. Both electrode surfaces have a surface roughness on the order of 20 nm.

Based on the analysis presented in this subsection, it is possible that the evaluated values for the Lifshitz-van der Waals constants deviate from the actual values due to the deformation of particles 100 and/or the electrode and the surface roughness of particles and the electrode. The large spread in the electric field required for particle removal is most likely contributed to significantly by the same two experimental variables, and to a lesser extent, the spread in particle size.

D. Lifshitz-van der Waals Constant

As discussed in a previous section, the Lifshitz-van der Waals constant is used to calculate the van der Waals force between two macroscopic materials and is a measure of the energy of the van der Waals interaction. For materials in atmosphere or vacuum, its value generally ranges from 0.6 to 9.0 eV and is obtained using dielectric spectroscopy.

Calculating the Lifshitz-van der Waals constant is beyond the scope of the present teachings, but is known to be difficult due to the lack of available optical data. Table 5 lists the expected ranges of the Lifshitz-van der Waals constants for a couple of the experimental material combinations using published values. For comparison, the evaluated values of the Lifshitz-van der Waals constants from the experimental results are included in the table.

TABLE 5

List of ranges of the expected values of the Lifshitz-van der Waals constant for select test cases compared with the evaluated values.

| Materials in Contact | Predicted Lifshitz-van der Waals Constant (eV) | Evaluated Lifshitz-van der Waals constant (eV) |
|---|---|---|
| Au—95Sn/5Sb | 6.6-8.2 | 4 |
| Au—Ag | 5.8-10.3 | 0.2 |

Note that the evaluated Lifshitz-van der Waals constants lay outside the range of predicted values for the given material properties, but are close to the expected range for all material combinations. There is possible error in the evaluated values as discussed in the previous subsection. But, according to Visser:

"Comparison of the theoretically calculated Lifshitz-van der Waals/Hamaker constants with those derived from experiments show that in a large number of cases the values from colloid chemistry and surface tension measurements deviate substantially from the theoretically calculated ones. This finding is a clear indication that the interpretations used for their calculation are based on incomplete theories."

Overcoming the Cohesion Force Using Ultra-Fine Particle Sieves

This section presents the feasibility of overcoming the cohesion force by using a method of transporting the dry particles 100 through sieve electrode system 12 to separate the clumped powder into individually isolated particles 100 prior to charging and acceleration as presented in the introduction. The details of the design and optimization of sieving electrode system 12 is beyond the scope of the present teachings. Results from a proof-of-concept experiment are presented with the goal of demonstrating the feasibility of this delivery system. The main goals of the proof-of concept experiment are to demonstrate the functionality of the first prototype by confirming that particles are charged, accelerated and ejected individually.

A. Experimental Setup

Figure 15:
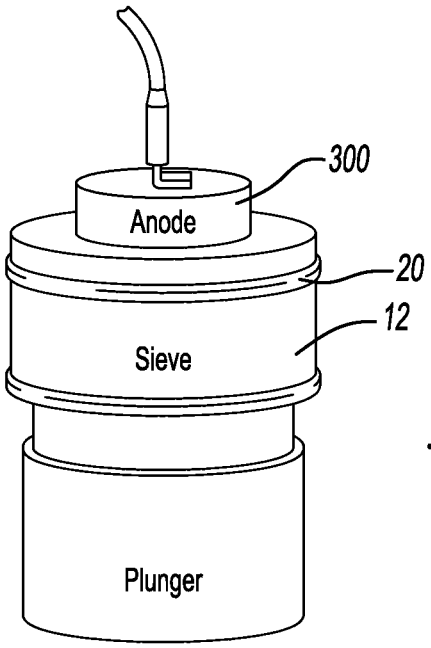
FIG. 15 is a photograph of a sieving delivery method according to the present teachings.

To experimentally investigate the method of delivering individual dry spherical particles through an ultra-fine sieve prior to charging and accelerating, the prototype shown in FIG. 15 was constructed using a stainless steel cloth with orifice diameters of approximately 20 μm and was tested with hollow aluminum spherical particles with diameters ranging from 5 μm to 20 μm. A cylindrical acrylic plunger is mounted beneath sieve electrode system 12 and the space between the plunger and sieve electrode system 12 acts as particle 100 reservoir. The weight of the sieving system on particle 100 reservoir, along with a mechanical vibrational source (not pictured), forces particles 100 through sieve electrode system 12. Mounted on the topside of sieve electrode system 12 is the charging grid, which is at a distance of approximately 7.5 mm from the surface of sieve electrode system 12 and has a single 5 mm orifice to allow the passage of particles. Above the charging grid 20 is the collection anode 300 used to collect all ejected particles.

Sieve electrode system 12 is electrically connected to ground while the charging grid 20 and the collection anode 300 are biased positive using a high voltage power supply to generate the charging electric field. Note that this prototype does not include any additional accelerating grids, but stacking additional grids above the charging grid 20 is possible. To verify that particles 100 were ejected individually and not clumped in groups, ejected particles were collected on glass slides placed just above the orifice in the charging grid and imaged using a scanning electron microscope (SEM).

B. Experimental Results

Figure 16:
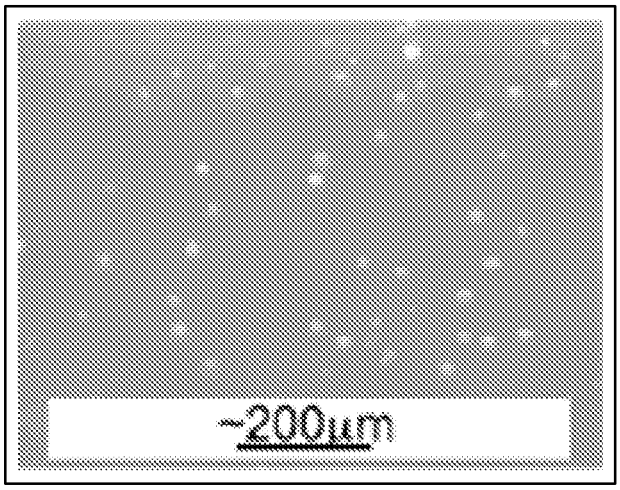
FIG. 16 is a scanning electron microscope (SEM) image illustrating aluminum particles collected on a glass slide after bombardment.

FIG. 16 is an SEM image of a glass slide after bombardment of the aluminum particles from the prototype for approximately one second. FIG. 16 shows that most of particles 100 collected by the slide are individual particles, which supports the theory that particles 100 are ejected individually. The proof-of-concept experimental results presented herein suggest that the sieving delivery method is capable of ejecting individually isolated particles continuously.

CONCLUSION

The effects of the adhesion and cohesion forces on the liquidless nanoFET system 10 were presented along with potential methods of overcoming them. For conducting particles in a dry environment, the dominant adhesion and cohesion force is the van der Waals force, which scales directly with the size of particle 100. Overcoming the adhesion force by removing spherical conducting particles from a planar source electrode by way of applied electric fields was investigated. The electric force responsible for particle removal scales directly with the square of the size of particle 100 while the adhesion force scales directly with the size of particle 100. This suggests that as the size of particle 100 decreases, the required electric field for removal increases. The models developed predict that particles with diameters down to hundreds or even tens of nanometers can be removed from a planar electrode. It should be appreciated that methods of reducing the required electrical force, such as the use of mechanical vibration, are also anticipated and discussed herein.

To investigate the particle removal model, eight test cases, involving 4 particle sizes and 2 electrode materials, were studied. The tests agreed reasonably well with the model when using values of the Lifshitz-van der Waals constants close to the expected ranges for all materials. But, the values evaluated from the experimental data disagree with published values for the specific material combinations. Note that many authors are not in agreement on the published values. In addition, the spread in the electric fields required to remove particles was large. The possible error in the Lifshitz-van der Waals constants and the spread of the electric fields may be attributed primarily to the surface roughness and deformation of both particles 100 and the electrode.

Overcoming the cohesion force in part by delivering particles 100 through an ultra-fine sieve was confirmed by performing a simple proof-of-concept experiment.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A particle field extraction system comprising:

a grid assembly having a plurality of electrodes each defining an electrical field, said grid assembly having a plurality of vias extending therethrough;

a reservoir having a generally dry mixture disposed therein;

a plurality of particles suspended in the generally dry mixture;

a biasing member applying a mechanical biasing force to the generally dry mixture in said reservoir;

a sieve electrode system in electrical communication with said grid assembly, said sieve electrode system having a plurality of through-holes extending from a first side adjacent said reservoir to a second side generally adjacent said grid assembly, said sieve electrode system cooperating with said biasing member to extract at least one of the plurality of particles from said generally dry mixture and into said grid assembly whereby said electrical fields charge and accelerate said at least one of the plurality of particles in said vias; and a device imparting a force on said sieve electrode system to said plurality of particles.

2. The particle field extraction system according to claim 1, wherein each of said plurality of through-holes of said sieve electrode system is sized to be greater than a diameter of said at least one of the plurality of particles and less than about twice the diameter of said at least one of the plurality of particles.

3. The particle field extraction system according to claim 1, wherein each of said plurality of through-holes of said sieve electrode system is sized to permit only a single one of said plurality of particles to pass therethrough at a time.

4. The particle field extraction system according to claim 1, further comprising:

said device imparting a force on said at least one of the plurality of particles to at least in part overcome particle cohesion and adhesion effects.

5. The particle field extraction system according to claim 4 wherein said device is a vibrational device.

6. The particle field extraction system according to claim 4, wherein said device is an acoustic device.

7. The particle field extraction system according to claim 4, wherein said device is coupled to said sieve electrode system.

8. The particle field extraction system according to claim 1 wherein said plurality of vias are each micron-size or smaller in cross-section.

9. The particle field extraction system according to claim 1 wherein said plurality of vias are each nano-size or smaller in cross-section.

10. The particle field extraction system according to claim 1 wherein said plurality of particles are each micro particles.

11. The particle field extraction system according to claim 1 wherein said plurality of particles are each nano-particles.

12. The particle field extraction system according to claim 1 wherein said grid assembly comprises:

a charging grid having said plurality of electrodes for said charging said at least one of the plurality of particles in said vias; and an acceleration grid having said plurality of electrodes for said accelerating said at least one of the plurality of particles in said vias

13. A nano-particle field extraction system for extracting a nano-particle from a generally dry mixture of a plurality of nano-particles, said nano-particle field extraction system comprising:

a reservoir containing the generally dry mixture of the plurality of nano-particles;

a sieve electrode system having a first side, a second side, and a plurality of through-holes extending from said reservoir on said first side to a volume on said second side of said sieve electrode system, said sieve electrode system defining an electrical field;

a biasing member applying a mechanical biasing force to the generally dry mixture of said reservoir urging at least one nano-particle of the generally dry mixture toward said sieve electrode system;

a grid assembly having a plurality of electrodes each defining an electrical field, said grid assembly having a plurality of vias extending therethrough, said grid assembly receiving said nano-particle from said sieve electrode system and charging and accelerating said nano-particle through said vias a device imparting a force on said sieve electrode system to said plurality of particles.

14. The nano-particle field extraction system according to claim 13, wherein each of said plurality of through-holes of said sieve electrode system is sized to permit only a single one of the plurality of nano-particles to pass therethrough at a time.

15. The nano-particle field extraction system according to claim 13, further comprising:

said device imparting a force on said nano-particle to at least in part overcome particle cohesion and adhesion effects.

16. The nano-particle field extraction system according to claim 15, wherein said device is a vibrational device.

17. The nano-particle field extraction system according to claim 15, wherein said device is an acoustic device.

18. The nano-particle field extraction system according to claim 15, wherein said device is coupled to said sieve electrode system.

19. The nano-particle field extraction system according to claim 13 wherein said grid assembly comprises:

a charging grid having said plurality of electrodes for said charging said at least one of the plurality of particles in said vias; and an acceleration grid having said plurality of electrodes for said accelerating said at least one of the plurality of particles in said vias.

* * * * *

UNITED STATES PATENT AND TRADEMARK OFFICE

CERTIFICATE OF CORRECTION

PATENT NO. : 8,453,427 B2
APPLICATION NO. : 12/506526
DATED : June 4, 2013
INVENTOR(S) : Brian E. Gilchrist et al.

It is certified that error appears in the above-identified patent and that said Letters Patent is hereby corrected as shown below:

In the Drawings

Drawing sheet 4, Fig. 9, delete “Planer” and insert --Planar--.

Drawing sheet 5, Fig. 10, delete “Planer” and insert --Planar--.

In the Specifications

Column 1, line 48, delete “characteristics” and insert --characteristic--.

Column 10, line 41, after “less”, insert --than--.

Column 11, line 40, before “67%”, insert --50%--.

Column 12, line 51, after “point”, insert --of--.

In the Claims

Column 17, line 13, in Claim 5, delete “claim 4” and insert --claim 4,--.

Column 17, line 36, in Claim 12, after “vias”, insert --.--.

Column 18, line 14, in Claim 13, delete “vias” and insert --vias;--.

Signed and Sealed this
First Day of October, 2013

Teresa Stanek Rea

Teresa Stanek Rea
*Deputy Director of the United States Patent and Trademark Office*